US005473341A

United States Patent [19]

Tomiyasu

[11] Patent Number: 5,473,341

[45] Date of Patent: Dec. 5, 1995

[54] DISPLAY CONTROL APPARATUS

[75] Inventor: Yuichi Tomiyasu, Tokyo, Japan

[73] Assignee: Kabushiki Kaisha Toshiba, Kawasaki, Japan

[21] Appl. No.: 252,042

[22] Filed: May 25, 1994

Related U.S. Application Data

[63] Continuation of Ser. No. 920,334, Jul. 29, 1992, abandoned.

[30] Foreign Application Priority Data

Jul. 30, 1991 [JP] Japan ..... 3-190362

[51] Int. Cl.[6] ..... G09G 1/00

[52] U.S. Cl. ..... 345/113; 345/116; 345/155; 348/589; 348/564

[58] Field of Search ..... 340/734, 721, 340/703; 358/183, 22; 345/152, 153, 154, 155, 113, 116, 112, 114, 115; 348/563, 564, 584, 586, 589

[56] References Cited

U.S. PATENT DOCUMENTS

| | | | |
|---|---|---|---|
| 4,450,442 | 5/1984 | Tanaka | 340/721 |
| 4,490,797 | 12/1984 | Staggs et al. | 340/721 |
| 4,639,721 | 1/1987 | Eto et al. | 340/721 |
| 4,682,297 | 7/1987 | Iwami | 340/721 |
| 4,888,582 | 12/1989 | Schnarel | 340/703 |
| 4,965,670 | 10/1990 | Klinefelter | 340/732 |
| 5,132,670 | 7/1992 | Miller | 340/703 |

FOREIGN PATENT DOCUMENTS

| | | |
|---|---|---|
| 0154067 | 11/1985 | European Pat. Off. . |
| 0177889 | 4/1986 | European Pat. Off. . |
| 54-161839 | 12/1979 | Japan . |
| 57-167079 | 10/1982 | Japan . |
| 57-185085 | 11/1982 | Japan . |
| 60-220387 | 11/1985 | Japan . |
| 4-191799 | 7/1992 | Japan . |

*Primary Examiner*—Tommy P. Chin
*Assistant Examiner*—A Au
*Attorney, Agent, or Firm*—Finnegan, Henderson, Farabow, Garrett & Dunner

[57] ABSTRACT

When a display control apparatus displays an 8-bit graphics data item and a 4-bit text data item, superimposed upon each other, on a display device which has pixels each having two dots it outputs, for one of the two dots an 8-bit text data item obtained by combining the 4-bit text data item with a 4-bit fixed data item, and outputs the 8-bit graphics data item for the other of the two dots. The display control apparatus has a multiplexer for outputting in order the upper 4 bits and lower 4 bits of the 8-bit graphics data item, each time a time period for displaying one dot elapses, a delaying circuit connected to the multiplexer, for generating delayed data items FG1 and FG2 by delaying the output GX of the multiplexer by a time period for displaying one dot and by a time period for displaying two dots, respectively, and a selection/output circuit. The selection/output circuit outputs the 8-bit text data for a first one of the two dots, and outputting, for a second one of the two dots, a data item obtained by combining the data items FG2 and FG1. Or, the selection/output circuit outputs, for the first dot, a data item obtained by combining the data items FG1 and GX, and outputs the 8-bit text data item for the second dot.

12 Claims, 8 Drawing Sheets

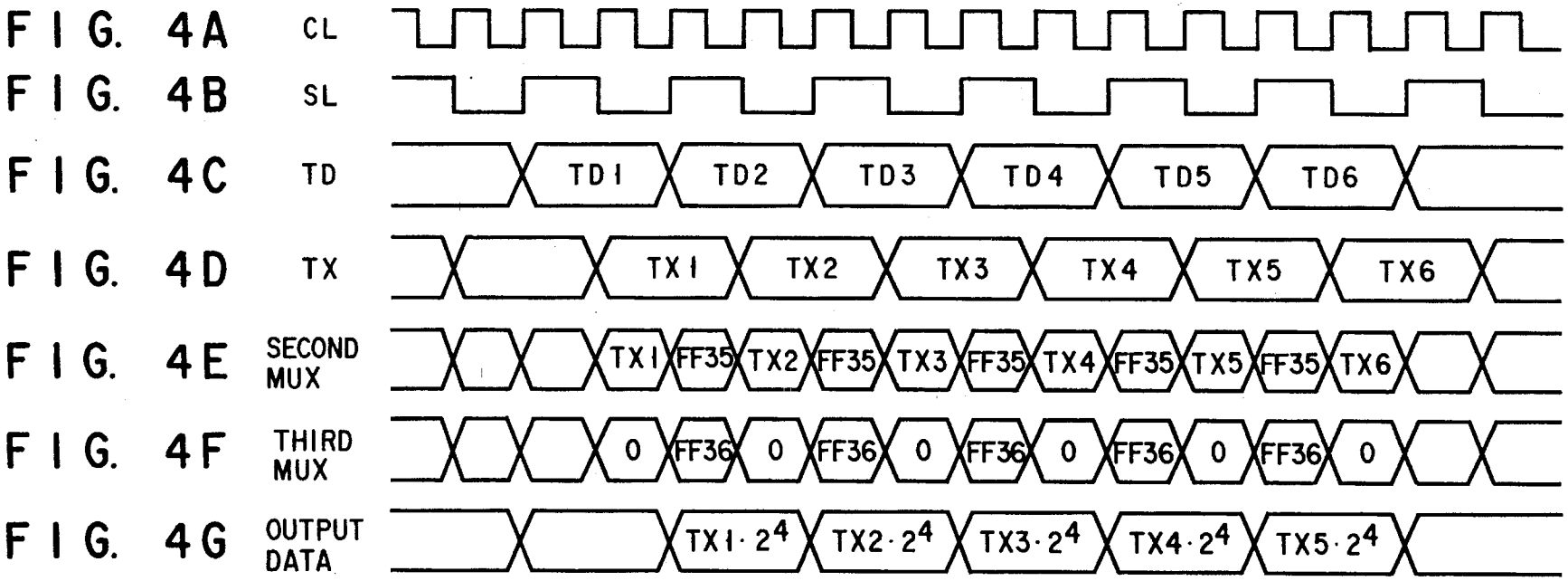
FIG. 4A CL
FIG. 4B SL
FIG. 4C TD
FIG. 4D TX
FIG. 4E SECOND MUX
FIG. 4F THIRD MUX
FIG. 4G OUTPUT DATA
TD1 TD2 TD3 TD4 TD5 TD6
TX1 TX2 TX3 TX4 TX5 TX6
TX1 FF35 TX2 FF35 TX3 FF35 TX4 FF35 TX5 FF35 TX6
0 FF36 0 FF36 0 FF36 0 FF36 0 FF36 0
TX1·2^4 TX2·2^4 TX3·2^4 TX4·2^4 TX5·2^4

DISPLAY CONTROL APPARATUS

This application is a continuation of application Ser. No. 07,920.334, filed Jul. 29, 1992, now abandoned.

BACKGROUND OF THE INVENTION

1. Field of the Invention

This invention relates to a display control apparatus having a function of superimposing graphics data and text data upon each other on a display.

2. Description of the Related Art

There is a known technique of superimposing a character, i.e., text data, upon a graphics image, i.e., graphics data, on a display apparatus such as a CRT or a FPD (Flat Panel Display).

In such a technique, in general, each character to be displayed is stored in a text memory in the form of a character code and attribute data indicative of display colors (colors of the character and the back ground), while each graphics image is stored in a graphics memory in the form of graphics data designating the color of each display pixel. Text data for designating the color of each display pixel on a display screen is generated from the character code and attribute data, and one of the text data and graphics data is selected and supplied to the display device, thereby obtaining a synthesized image.

In the conventional display control apparatus, however, the text data can be superimposed upon the graphics data only when the bit numbers (widths) of the both data items are equal to each other. For example, graphics data of 8 bits (256 colors can be designated) cannot be superimposed upon text data of 4 bits (16 colors can be designated). Therefore, where graphics data is superimposed upon text data of 4 bits, more than 16 colors cannot be used for displaying a graphics image, though 256 colors can be used at most if only the graphics data is used.

SUMMARY OF THE INVENTION

It is an object of the invention to provide a system capable of superimposing, on a screen, text data upon graphics data of a bit width different from that of the text data.

It is another object of the invention to enable various colors to be used at the time of superimposing the text data and graphics data upon each other.

According to the present invention, there is provided a display control apparatus for superimposing and displaying a graphics data item and a text data item having different bit widths on a display device, the display control apparatus comprises text data supply means for supplying text data items each having an m-bit width, m being a positive integer larger than 1, graphics data supply means for supplying graphics data items each having an n bit width, n being a positive integer larger than the m, division means connected to the graphics data supply means, for dividing the graphics data item into data items each having the m-bit width, text data selection/output means, connected to the text data supply means, for receiving the text data item and generating an n-bit text data item by combining the text data item with a predetermined constant data item, thereby displaying the resultant text data item on the display device in a superimposition mode, and graphics data selection/output means connected to the division means, for selecting, in response to output timing of the n-bit text data item from the text data selection/output means, the data items obtained as a result of division by division means, and restoring the selected data items to an n-bit-width data item, thereby displaying the restored text data item on the display device in a superimposition mode.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 3A to 5J are timing charts, useful in explaining the operation of the embodiment;

DETAILED DESCRIPTION OF THE PREFERRED EMBODIMENT

An embodiment of the invention will be explained with reference to the accompanying drawings.

Figure 1:
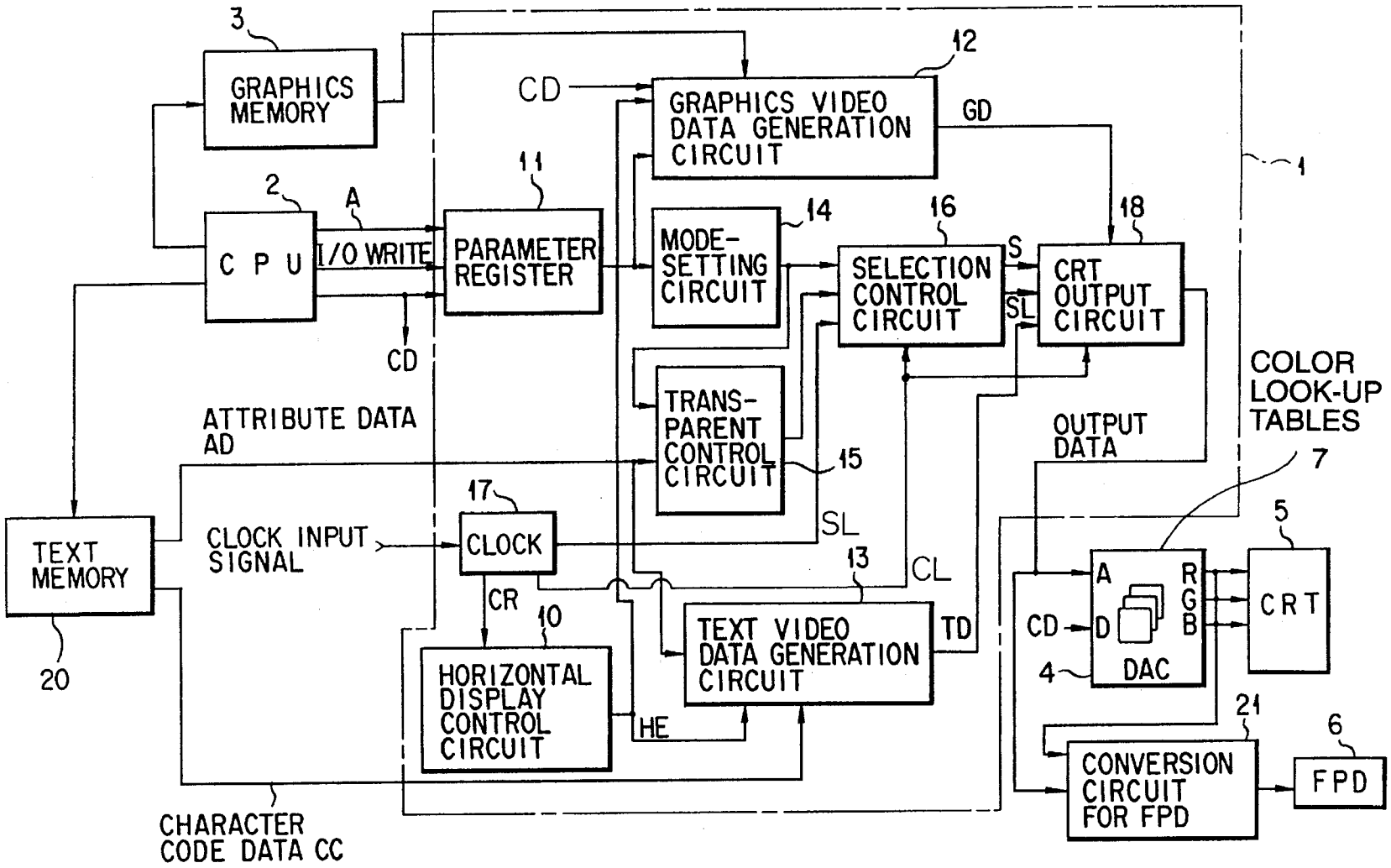
FIG. 1 is a block diagram, showing an essential part of a display control apparatus according to an embodiment of the invention.
Figure 2:
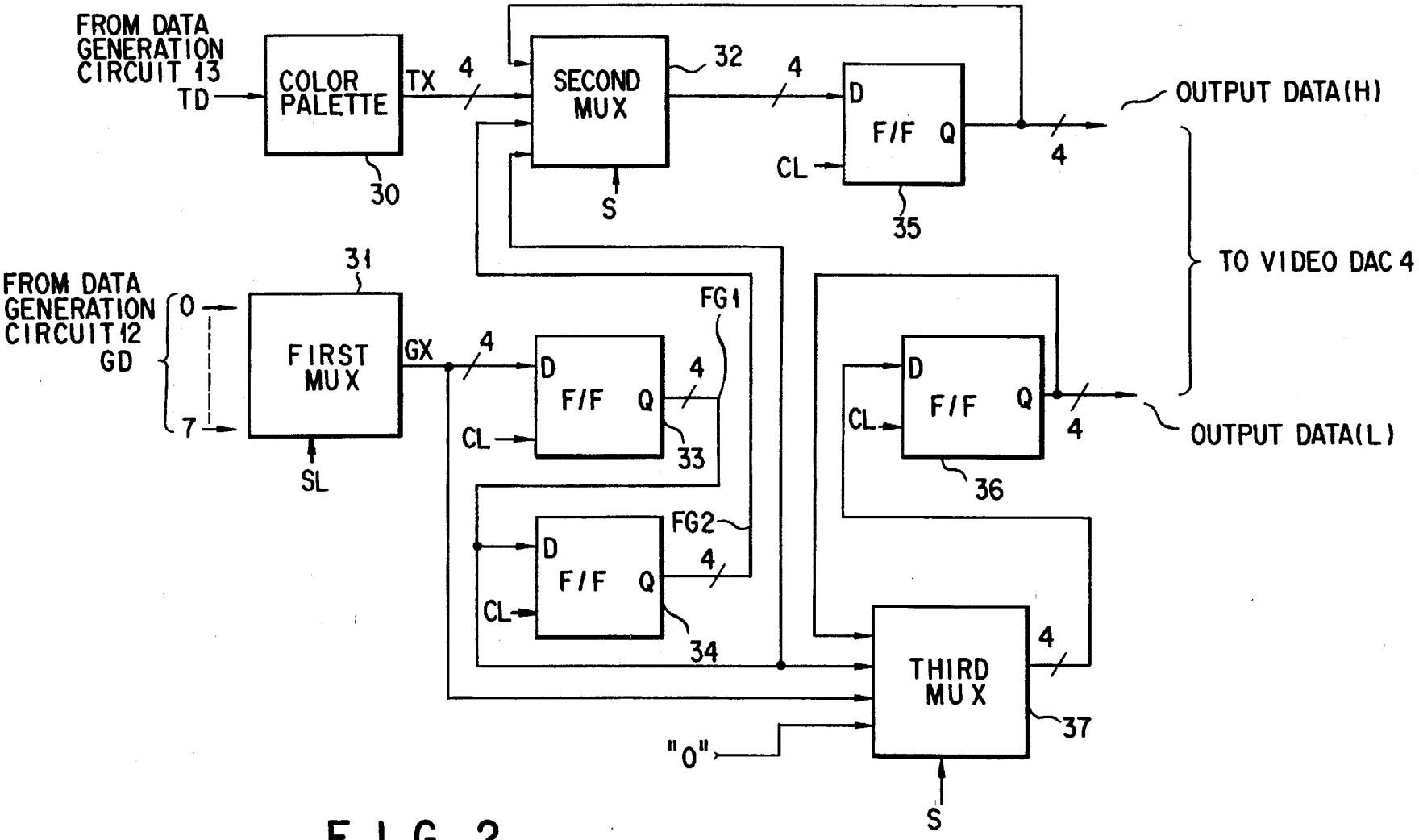
FIG. 2 is a block diagram, showing a CRT output circuit employed in the embodiment of FIG. 1.

FIG. 1 is a block diagram, showing a display system according to an embodiment of the invention. FIG. 2 shows a CRT output circuit employed in the system of FIG. 1.

As is shown in FIG. 1, the display system comprises a display control circuit 1, a CPU (Central Processing Unit) 2, a graphics memory 3, a video DAC 4, a CRT display device (hereinafter called a "CRT") 5, a flat display device (hereinafter called a "FPD") 6 such as a liquid crystal display device or a plasma display device, a text memory 20, and a conversion circuit 21 for the FPD.

The CPU 2 controls the entire system.

The graphics memory 3 comprises four memory planes corresponding to R (Red), G (Green), B (Blue), and I (Intensity). In the embodiment, each graphics data includes of four 2-bit data items read out of the four memory planes (i.e., the graphics data is of 8 bits in total), and determines the color and intensity of a corresponding pixel (which includes of two dots for one scanning line in the embodiment) on a display screen.

The text memory 20 stores a character code CC (of 8 bits or 16 bits) and attribute data AD of 8 bits (which includes two 4-bit data items respectively indicating the color of a character and that of the back ground).

The DAC 4 has 256 color look-up table and 3 D/A converters. Each color look-up table is selected using the 8 bits output from the display control circuit 1 or an address, and stores R-, G-, and B-color data items of 18 bits (i.e., each data item is of 6 bits). Each D/A converter converts corresponding R-, G-, and B-color data read from a selected color look-up table, to R-, G-, and B-color analog image signals, and supplies the signals to the CRT 5. In the CRT 5, one pixel includes two dots on a horizontal scanning line.

The converter circuit 21 converts the analog image signals output from the video DAC 4, to a signal dedicated to the FPD 6, and supplies a conversion result to the FPD 6.

The display control circuit 1 operates under the control of the CPU 2, and reads data from the graphics memory 3 and text memory 20, thereby synthesizing them and outputting resultant data as display data for the CRT 5 or FPD 6.

Then, the structure of the display control circuit will be explained.

The circuit 1 comprises a horizontal display control circuit 10, a parameter register 11, a graphics video data generation circuit 12, a text video data generation circuit 13, a mode-setting circuit 14, and a transparent control circuit 15.

The parameter register 11 stores various parameters transmitted from the CPU 2. The parameters include an address A, an I/O write control signal, display data CD, and parameters indicative of whether transparent mode should be set, and indicative of whether the display data CD is text display data, graphics display data, or synthesized display data.

The mode-setting circuit 14 acting as a designation means, is responsive to the parameters stored in the parameter register 11, for setting various modes such as a graphics image display mode, a text display mode, a graphics image-text-superimposition display mode, and a transparent mode. The graphics image display mode is a mode for displaying a graphics image stored in the graphics memory 3, the text display mode is a mode for displaying a text stored in the text memory 20, and the superimposition display mode is a mode for displaying a graphics image and a text superimposed on each other. The transparent mode is a mode for displaying graphics data on one of the two dots of each pixel and text data on the other, as regards a portion in which a graphics image and a character are superimposed on each other; and displaying graphics data on the two dots of each pixel as regards a portion in which a graphics image and a background character are superimposed on each other.

The transparent control circuit 15 outputs a transparent control signal on the basis of the transparent mode from the mode-setting circuit 14 and attribute data (display attribute data) AD from the text memory 20.

A clock generation circuit 17 generates clock signals CR and CL, and a load signal SL. The clock signals CR and CL are clock pulses for determining the horizontal display time point of each dot on the screen of the display device, and the load signal SL determines the time point of displaying each pixel (two dots) on the screen.

The horizontal display control circuit 10 is responsive to the clock signal CR from the clock generation circuit 17, for outputting a signal HE designating a dot number in a horizontal scanning line, to the graphics video data generation circuit 12 and text video data generation circuit 13.

A selection control circuit 16 is synchronous with the clock signal CL and load signal SL from the clock generation circuit 17, for supplying a CRT output circuit 18 with the load signal SL and a selection signal S.

The graphics video data generation circuit 12 operates under the control of the CPU 2, and is responsive to the mode set by the mode-setting circuit 14, acting as a means for reading data from the graphics memory 3, and for converting graphics data stored in the graphics memory 3, to graphics video data GD. The circuit 12 outputs the graphics video data GD at an appropriate time point in response to the control signal HE from the horizontal display control circuit 10. Each item of graphics video data GD is 8-bit data for designating the color of a pixel on the screen.

The text video data generation circuit 13 operates under the control of the CPU 2, and reads character code data CC and attribute data AD corresponding to the character code data CC from the text memory 20, thereby outputting corresponding text video data TD at an appropriate time point in response to the control signal HE. More specifically, the circuit 13 converts, using a character generator, character code data CC, to a dot pattern. Then, the circuit 13 outputs, as the text video data TD, 4-bit data indicative of the character color of the attribute data when the dot is "1", and outputs, as the text video data TD, 4-bit data indicative of the back ground color of the attribute data when the dot is "0".

The CRT output circuit 18 is responsive to the load signal SL and selection signal S from the selection control circuit 16, for outputting one of 8-bit graphics data GD and 4-bit text data TD, or for superimposing the graphics data and text data on each other and outputting the superimposed data, so as to perform a display according to a set mode.

The structure of the CRT output circuit 18 will now be explained with reference to FIG. 2. The circuit 18 comprises a color palette 30, a first multiplexer (MUX) 31, a second multiplexer (MUX) 32, flip-flop circuits (F/F) 33–36, and a third multiplexer (MUX) 37.

The color palette 30 has 16 palette registers to be selected in accordance with 4-bit text video data (color attribute data) TD supplied from the video data generation circuit 13. Each palette register keeps 4-bit color text data (color designation data) TX.

The first multiplexer 31, in response to the load signal SL, selects the upper 4-bit data (4–7th bits) of the 8-bit graphics video data GD output from the video data generation circuit 12 when the load signal SL is at high level, and selects the lower 4-bit data (0–3rd bits) when the load signal SL is at low level, thereby outputting the selected data as the data GX.

The flip-flop 33 outputs data FG1 obtained by delaying, by one clock pulse of the clock signal CL, the data GX output from the first multiplexer 31. The flip-flop 34 outputs data FG2 obtained by delaying the data GX by two clock pulses of the clock signal CL.

The second multiplexer 32 is responsive to the selection signal S from the selection control circuit 16, for selecting one of the color text data TX, data FG1 and FG2, and an output from the flip-flop 35, and outputting the selected data. The flip-flop 35 latches the output data of the second multiplexer 32 in synchronism with the clock signal CL. The flip-flop 35 supplies the latched data to the second multiplexer 32, and supplies to the video DAC 4 the latched data as the upper 4 bits of the 8-bit output data of the display control circuit 1.

The third multiplexer 37 is responsive to the selection signal S, for selecting one of the data GX, data FG1, an output from the flip-flop 36, and data "0000", and outputting the selected data. The flip-flop 36 latches the output data of the third multiplexer 37 in synchronism with the clock signal CL. The flip-flop 36 supplies the latched data to the third multiplexer 37, and supplies to the video DAC 4 the latched data as the lower 4 bits of the 8-bit output data of the display control circuit 1.

Then, the operation of the embodiment shown in FIGS. 1 and 2 will be explained.

First, in accordance with an application program, etc., the CPU 2 writes graphics data into the graphics memory 3 for determining a graphics image to be displayed, and writes into the text memory 20 the character code CC and attribute data AD of a character to be displayed.

Subsequently, the CPU 2 determines parameters for setting a display mode and a parameter relating to transparent control. The mode-setting circuit 14 outputs a mode designation signal indicative of the set display mode in accordance with the determined parameter.

The transparent control circuit 15 is responsive to the mode-setting signal from the mode-setting circuit 14 and the attribute data AD from the text memory 20, for outputting a transparent control signal indicating whether or not transparent control should be done in units of pixel. For example, where the attribute data AD from the text memory 20 designates a particular color, and the CPU 2 instructs "transparent" of this color, the transparent control circuit 15 outputs a signal instructing that the transparent control should be done. Such transparent control is disclosed in detail, for example, in Published Unexamined Japanese Patent Applications Nos. 54-161839, 57-167079, 57-185085, and 60-220387. Therefore, explanation of the control is omitted here.

The selection control circuit 16 is responsive to signals from the mode-setting circuit 14 and transparent control circuit 15, for outputting, the selection control signal S designating signals to be selected by the second and third multiplexers 32 and 37.

The graphics video data generation circuit 12 reads, from the graphics memory 3, 8-bit graphics data determining the color attribute of pixels to be displayed then converting the read-out data to a corresponding graphics video data GD, and supplying the data GD to the CRT output circuit 18.

The text video data generation circuit 13 reads the character code CC and attribute data AD of a character to be displayed. Further, the circuit 13 converts the read character code CC to pattern data, using the character generator. Then, on the basis of the obtained pattern and attribute data AD, the circuit 13 creates 4-bit graphics text data TD corresponding to the displayed color of a pixel to be displayed, and supplies the created data to the CRT output circuit 18.

The CRT output circuit 18 will now be explained.

In a Case where Display of a Graphics Image is Designated

Figures 3A, 3B, 3C, 3D, 3E, 3F, 3G:
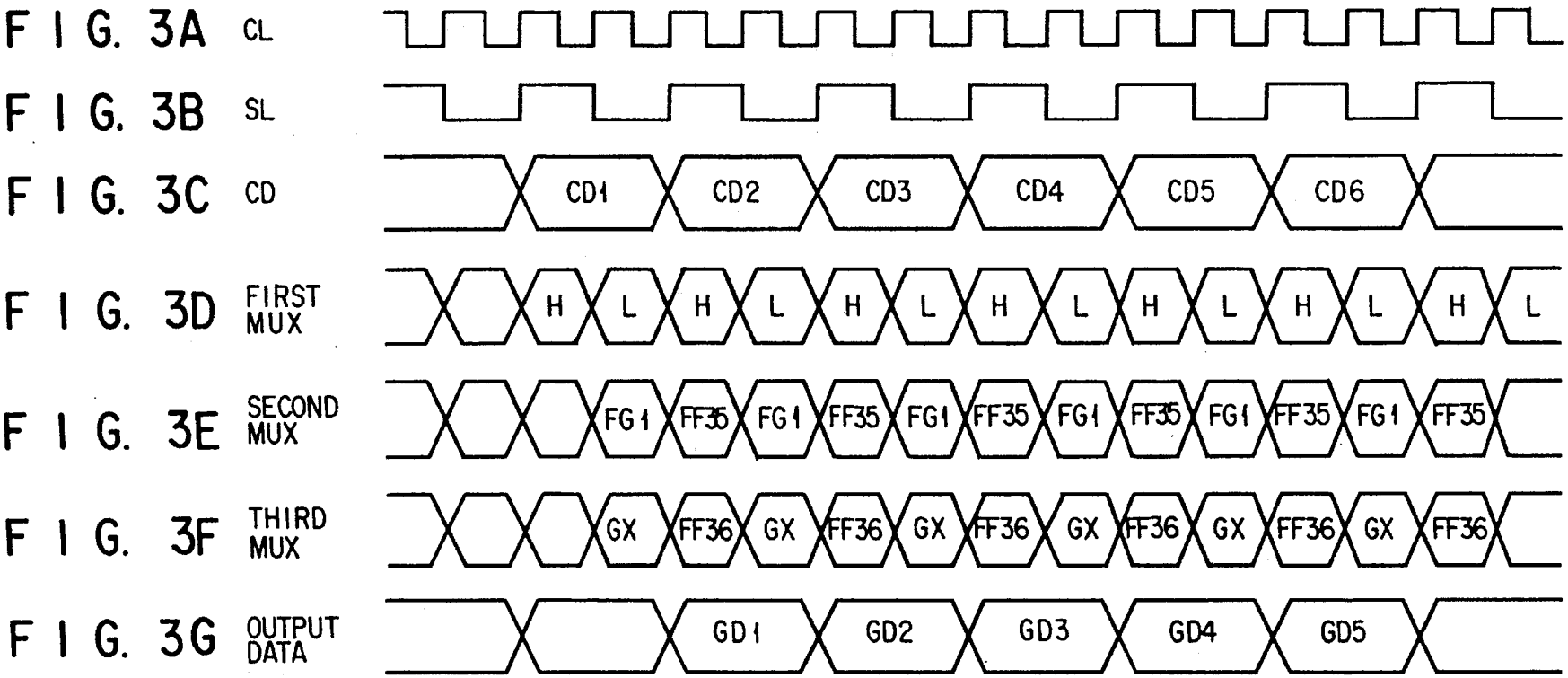

The first multiplexer 31 responds to the load signal SL shown in FIG. 3B, and sequentially selects and outputs, as shown in FIG. 3D, the upper 4 bits and lower 4 bits of the graphics data GD supplied from the graphics video data generation circuit 12 at the timing shown in FIG. 3C.

As is shown in FIGS. 3E and 3F, in response to the selection signal S, the second and third multiplexers 32 and 37 select the data items FG1 and GX, respectively, at the time of the load signal SL being at low level. The output of the second multiplexer 32 is delayed by one clock pulse by the flip-flop 35, and then supplied, as the upper-bit data, to the video DAC 4. The output of the third multiplexer 37 is supplied, as the lower-bit data, to the video DAC 4 via the flip-flop 36.

Further, as is shown in FIGS. 3E and 3F, the second and third multiplexers 32 and 37 select the outputs Q of the flip-flops 35 and 36, respectively, in response to the selection signal S at the time of the load signal SL being at high level. The outputs of the second and third multiplexers 32 and 37 are supplied to the video DAC 4 via the flip-flops 35 and 36.

Accordingly, as is shown in FIG. 3G, the display control circuit 1 delays the video graphics data GD supplied from the data generation circuit 12, by a cycle of the load signal SL, i.e., by a time period for displaying one pixel, and outputs the delayed data to the video DAC 4. The video DAC 4 converts the received data to R-, G-, and B-color data items each of 6 bits, and then subjects these color data items to D/A conversion, thereby outputting the conversion result to the CRT 5.

In a Case Where Display of a Text is Designated

The text data TD supplied from the text video data generation circuit 13 at the timing shown in FIG. 4C is used as an address to select one of color palette registers in a color palette 30, and 4-bit color text data TX stored in the selected color palette register is output as shown in FIG. 4D. As is shown in FIGS. 4E and 4F, the second and third multiplexers 32 and 37 select the color text data TX and fixed data "0000", respectively, in response to the selection signal S, during the load signal SL being at low level. The output of the second multiplexer 32 is supplied, as the upper-bit data, to the video DAC 4 via the flip-flop 35, while the output of the third multiplexer 37 is supplied, as the lower-bit data, to the video DAC 4 via the flip-flop 36. That is, the display control circuit 1 outputs data $TX\times2^4$, as is shown in FIG. 4E.

As is shown in FIGS. 4E and 4F, when the level of the load signal SL becomes high, the second and third multiplexers 32 and 37 select the outputs Q of the flip-flops 35 and 36, respectively, in response to the selection signal S. In other words, the second and third multiplexers 32 and 37 generate the data $TX\times2^4$ having output half a cycle before. The outputs of the second and third multiplexers 32 and 37 are delayed by one clock pulse by means of the flip-flops 35 and 36, and are supplied to the video DAC 4. Accordingly, the display control circuit 1 outputs the data "$TX\times2^4$", as is shown in FIG. 4G.

The video DAC 4 selects a color register based on the output data $TX\times2^4$, converts data stored in the register, to R-, G-, and B-color data items each of 6 bits, subjects the color data items to D/A conversion, and outputs the conversion result to the CRT 5.

Figures 5A, 5B, 5C, 5D, 5E:
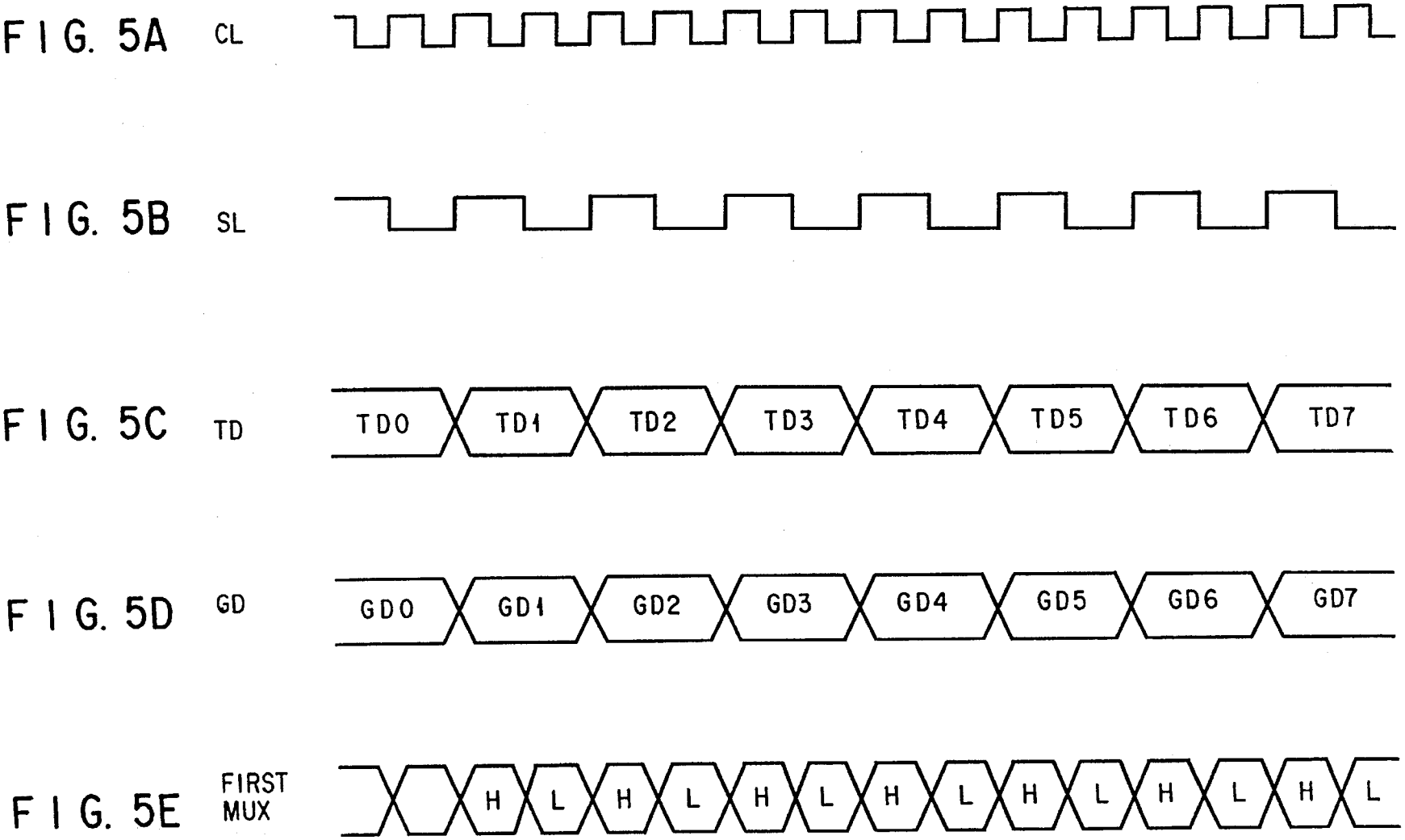

In a Case Where Display of a Synthesized Image of a Graphics Image and a Text is Designated In this case, as is shown in FIGS. 5C and 5D, the text video data TD and the graphics video data GD are sequentially supplied to the CRT output circuit 18. As is shown in FIG. 5E, the first multiplexer 31 responds to the load signal SL, and outputs the upper 4 bits of the graphics video data and the lower 4 bits of the same, alternately.

Figures 5F, 5G, 5H, 5I, 5J:
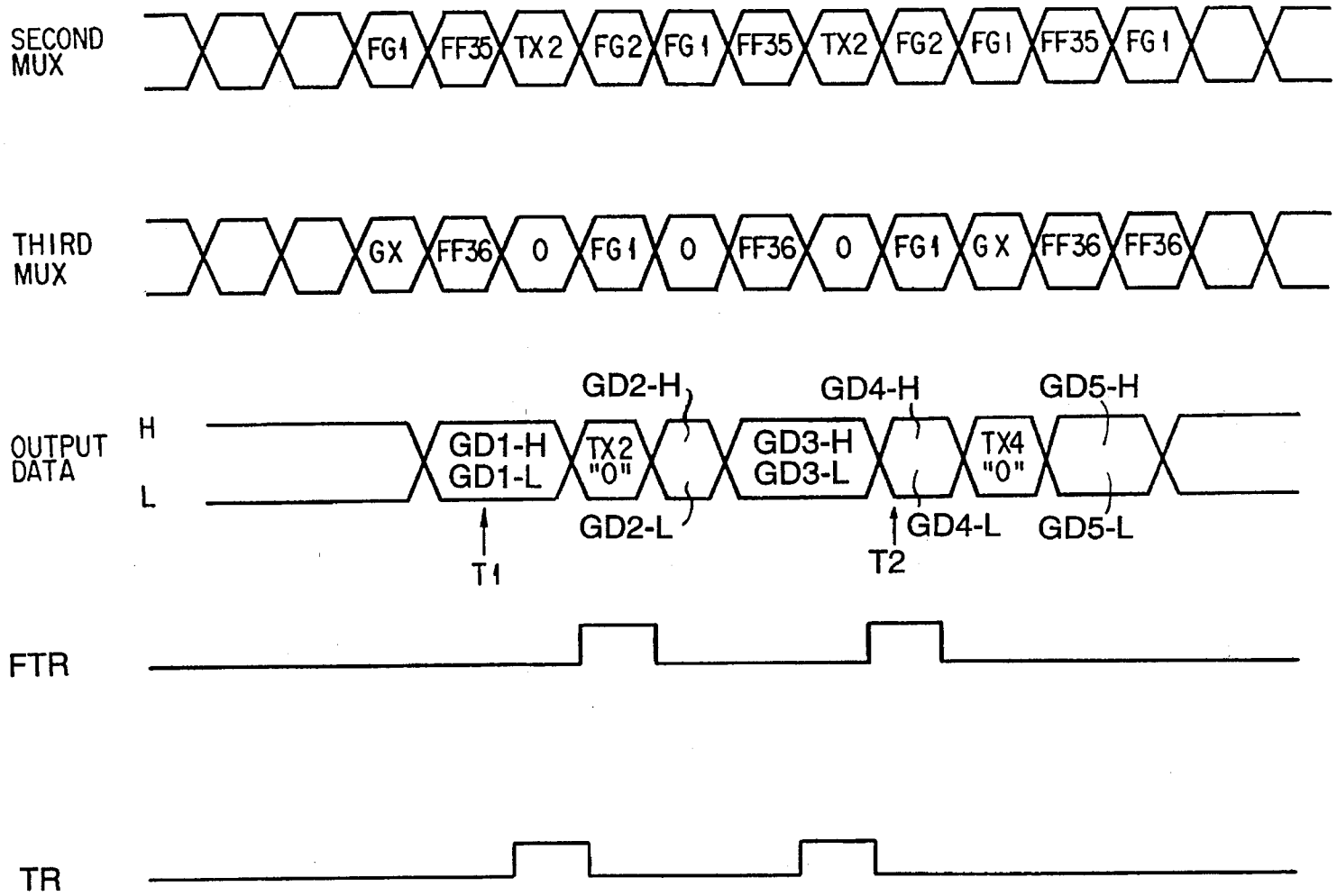

A "superimposition and transparent mode" is designated in units of one pixel. Thus, as regards a pixel to which designation of superimposition is not given, the second and third multiplexers 32 and 37 respectively select, in response to the selection signal S, the data FG1 and GX when the load signal SL is at low level, and the outputs of the flip-flops 35 and 36 when the load signal SL is at high level, as is shown in FIGS. 5F and 5G. Accordingly, the output of the display control apparatus 1 corresponds to graphics data delayed by a time period for displaying one pixel.

On the other hand, when the "superimposition and transparent mode" is designated, the selection control circuit 16 outputs the control signal S, which causes the second multiplexer 32 to select the color text data TX, and the third multiplexer 37 to select the data "0000". Upon receiving the selection signal S, the second multiplexer 32 selects the color text data TX, and the third multiplexer 37 selects the data "0000". These selected data items are delayed by one clock pulse by the flip-flops 35 and 36, respectively, and then output to the video DAC 4.

As is indicated by the time point T1, when the second multiplexer 32 selects the color text data TX4 at the time of the load signal SL being at high level, it selects the data FG1 when the load signal SL becomes at low level, and the third multiplexer 37 selects the data GX at the same time point. Thus, the text data $TX \times 2^4$ is displayed on the back one of the two dots constituting one pixel, while the graphics data GD is displayed on the front one of them.

Further, as is indicated by the time point T2, when the second multiplexer 32 selects the text data TX2 at the time of the load signal SL being at low level, the graphics data GD is displayed on the back one of the two dots, while the text data $TX \times 2^4$ is displayed on the front one of them, since the second and third multiplexers 32 and 37 respectively selected the data FG2 and FG1 at the time of occurrence of a clock pulse immediately before the current clock pulse, at which the load signal SL was at low level.

That is, as is shown in FIG. 5H, the text data TD of 16 colors and 4 bits is superimposed upon the graphics video data GD of 256 colors and 8 bits, and the superimposed data items are displayed in color.

As is explained above, in the embodiment, when the superimposition mode is designated, the text data is displayed on one of the two dots of one pixel, and the graphics data on the other. Accordingly, even if the graphics data and text data have bit widths differing from each other, they can be superimposed on each other.

Though one pixel includes of two dots for one scanning line in the above embodiment, the invention is not limited to this, but may be modified such that one pixel includes four dots on one scanning line, and that each of text data and graphics data is displayed on two of the four dots when a superimposition mode is designated.

Further, in the invention, the bit number of each data is not limited to that specified in the embodiment, but may be varied. In the above embodiment, the multiplexer 31 outputs first the upper 4 bits of the graphics data GD and then the lower 4 bits of the same. However, the multiplexer 31 may be modified such that it outputs first the lower 4 bits of the graphics data GD and then the upper 4 bits. In this case, to display, for example, the graphics data, the second and third multiplexers 32 and 37 select the data items GX and FG1, respectively. Moreover, at the time of selecting the text data TX for the first dot of one pixel, the second and third multiplexers 32 and 37 select the data items FG1 and FG2 for the second dot. In addition, so as to convert the 4-bit text data TX to 8-bit text data, in the embodiment, the fixed data "0000" is combined with the 4-bit text data TX to serve as the lower-bit data of the same. Alternatively, the data "0000" may be used as the upper data of the data text TX. Also, fixed data other than the data "0000" may be combined with the text data TX.

Figure 6:
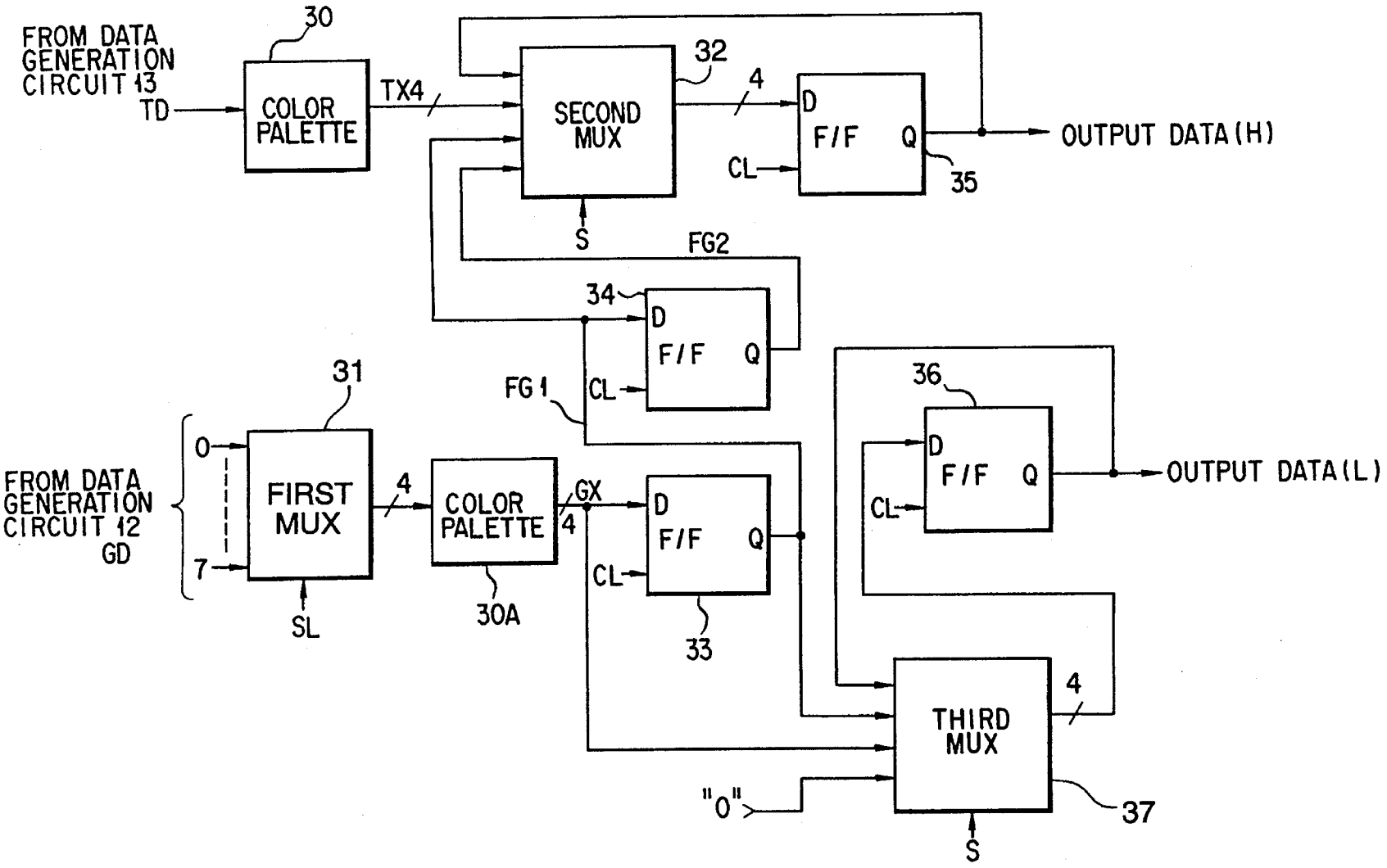
FIG. 6 is a block diagram, showing a modification of the CRT output circuit of FIG. 1.

FIG. 6 shows a variation of the CRT output circuit 18 of FIG. 2. The structure of FIG. 6 differs from that of FIG. 2 in that it has a color palette 30A located between the output terminal of the multiplexer 31 and first flip-flop 33. The color palette 30A has 16 color palette registers to be selected on the basis of 4-bit data output from the multiplexer 31.

The selected register outputs 4-bit color data stored therein, to the first flip-flop 33 and multiplexer 37. The operation in a later stage is identical to that of the circuit of FIG. 2. It is possible to operate the circuit of FIG. 2 without the color palette registers.

Figure 7:
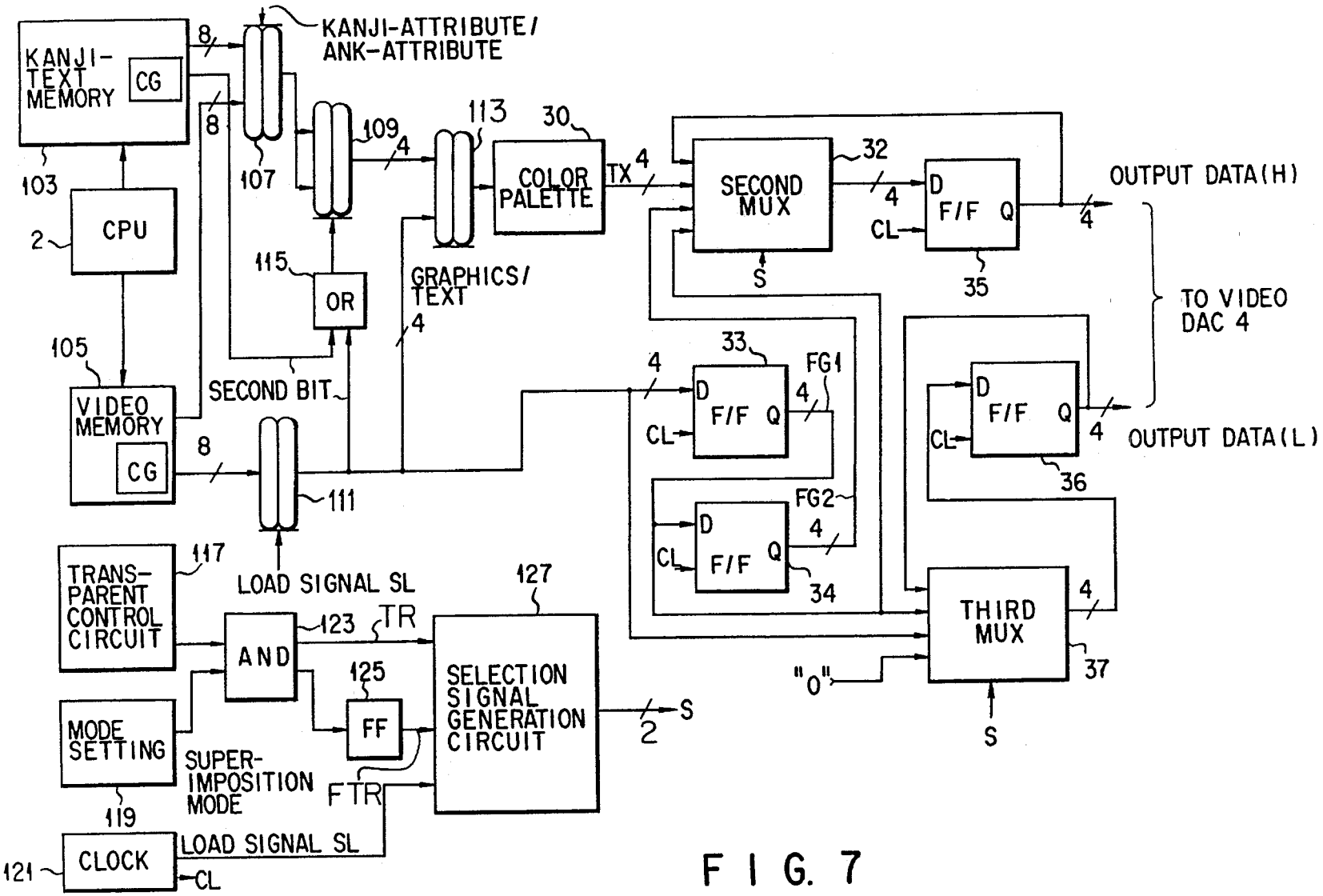
FIG. 7 is a circuit diagram, showing a detail structure of the display control apparatus shown in FIGS. 1 and 2.

One detailed construction of the display control circuit 1 shown in FIGS. 1 and 2 will now be explained with reference to FIG. 7. In FIG. 7, elements identical to those in FIG. 2 are denoted by identical reference numerals, and explanation thereof is omitted.

A display control apparatus shown in FIG. 7 comprises a CPU 2, a Kanji-character text memory 103, a video memory 105, multiplexers (MUXs) 107–113, an OR-gate 115, a transparent control circuit 117, a mode-setting circuit 119, a clock generation circuit 121, an AND-gate 123, a flip-flop (F/F) 125, a selection signal generation circuit 127, color palettes 30, multiplexers (MUXs) 32 and 37, and flip-flops (F/F) 33–36. .

The CPU 2 controls the entire system. The Kanji-character text memory 103 stores a 16-bit Kanji(Chinese)-character code and 8-bit attribute data (consisting of 4-bit data for designating a character color and 4-bit data for designating a back ground color). The memory 103 has a character generator for generating a character pattern on the basis of the Kanji-character code, and outputs the character pattern. The video memory 105 stores graphics data including dot-pattern data having a depth of 8 bits, an 8-bit ANK (Alpha-Numeric Kana) code, and 8-bit attribute data. The video memory 105 has a character generator, generates a character pattern from the ANK code, and outputs the character pattern. The video memory 105 also outputs a dot pattern data having a depth of 8 bits.

The 8-bit attribute data output from the Kanji-character text memory 103 and that output from the video memory 105 are supplied to the multiplexer 109 via the multiplexer 107. The multiplexer 107 is responsive to a signal supplied from the CPU 2, for selectively outputting one of the Kanji attribute data and ANK attribute data. The multiplexer 109 is responsive to a signal output from the OR-gate 115, for selectively outputting one of the upper 4 bits (designating a character color) of the attribute data supplied from the multiplexer 107 and the lower 4 bits (designating a back ground color) of the same.

The 8-bit graphics data from the video memory 105 is supplied to the multiplexer 111. The multiplexer 111 is responsive to the load signal SL for outputting the upper 4 bits of the graphics data at the time of the load signal SL being at high level, and outputting the lower 4 bits at the time of the load signal SL being at low level.

The output data of the multiplexer 109 and that of the multiplexer 111 are supplied to the multiplexer 113. The multiplexer 113 responds to a signal from the CPU 2 selects one of the 4-bit graphics data and 4-bit text data, thereby supplying the selected data to the color palette 30. The color palette 30 has 16 color palette registers to be selected by the 4-bit data supplied from the multiplexer 113. Each palette register stores 4-bit color-designating data.

The 4-bit output data of the multiplexer 111 is supplied further to the flip-flop 33 and multiplexer 37.

The transparent control circuit 117 designates the transparent mode in units of one pixel under the control of the CPU 2. The mode-setting circuit 119 designates the superimposition mode in units of one pixel. The AND-gate 123 outputs a signal having a logic "1" when the "transparent and superimposition mode" is designated. The flip-flop 125 delays the output of the AND-gate 123 by one clock pulse.

The selection signal generation circuit 127 generates the selection signal S, in response to the outputs of the AND-gate 123, flip-flop 125, and the load signal SL.

Then, the operation of the display control apparatus shown in FIG. 7 will be explained, referring to the case of displaying a synthesized image of a graphics image and a text.

In accordance with an application program, etc., the CPU 2 writes into the video memory 105 graphics data or an ANK code for determining a graphics image to be displayed, and further writes into the Kanji-character text memory 103 the character code and attribute data of a Kanji character to be displayed.

The video memory 105 reads out display data under the control of the CPU 2, and supplies the read-out data to the multiplexer 111 when the display data is dot pattern data. On the other hand, when the display data is the ANK code, the memory 105 converts the display data to a bit map pattern with the use of a character generator, and supplies the bit map pattern and attribute data to the multiplexers 111 and 107, respectively.

The Kanji-character text memory 103 reads out a Kanji-character code to be displayed under the control of the CPU 2, and develops a bit map pattern with the use of its character generator. Data (second bit) indicating whether each dot on the bit map pattern is in the on or off state is supplied to the OR-gate 115, and corresponding attribute data is supplied to the multiplexer 107.

The multiplexer 107 responds to a Kanji-character attribute data/ANK attribute data changing signal supplied from the CPU 2, and outputs one of the attribute data items.

The multiplexer 111 responds to the load signal SL, and divides the 8-bit data into two 4-bit data items, thereby outputting the two 4-bit data items separately.

The second bit of the output of the multiplexer 111 is supplied to the OR-gate 115.

The bit data item supplied from the memory 103 to OR-gate 115 and the second bit supplied from the multiplexer 111 to the OR-gate 115 indicate whether or not a corresponding pixel is in the on-state. If the corresponding pixel is in the on-state, the display color of the pixel corresponds to the character color designated by the attribute data. If, on the other hand, the corresponding pixel is in the off-state, the display color of the pixel corresponds to the back ground color designated by the attribute data. Accordingly, the multiplexer 109 selects the seventh–fourth bits (designating the character color) of the attribute data supplied from the multiplexer 107, when the output of the OR-gate 115 is "1" (indicating the on-state), and selects the third–0th bits (designating the back ground color) of the attribute data when the output is "0" (indicating the off-state).

The multiplexer 113 is responsive to the signal from the CPU 2, for selectively outputting data from the multiplexer 111 when display of graphics data is designated, and outputting data from the multiplexer 109 when display of text data is designated.

The data selected by the multiplexer 111 is converted to 4-bit color data by the color palette 30, and is supplied to the multiplexer 32.

The transparent control circuit 117 outputs a signal which assumes an active level when transparent (graphics display mode) is designated. When the circuit 117 outputs a signal of an active level, and at the same time the mode-setting circuit 119 designates the superimposition mode, the AND gate 123 has an output of "1" level. The selection signal generation circuit 127 responds to the output of the AND gate 123, a signal obtained by delaying the output by one clock pulse, and the load signal SL, thereby causing the multiplexers 32 and 37 to select data as follows:

| TR | FTR | SL | MUX32 | MUX37 |
|---|---|---|---|---|
| 0 | 0 | L | FG1 | GX |
| 0 | 0 | H | FF35 | FF36 |
| 1 | 0 | L | TX2 | 0 |
| 0 | 1 | H | FG2 | FG1 |
| 1 | 0 | H | TX4 | 0 |

The multiplexers 32 and 37 select data in order as indicated in the timing charts in FIGS. 5F and 5G, thereby displaying 4-bit text data and 8-bit graphics data superimposed upon each other.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A display control apparatus for outputting graphics data and text data having different bit widths to a display device, the display control apparatus comprising:

text data supply means for supplying the text data each having an m-bit width, m being a positive integer larger than 1;

graphics data supply means for supplying the graphics data each having an n-bit width, n being a positive integer larger than m;

division means connected to the graphics data supply means, for dividing the graphics data supplied from the graphic data supply means into data each having the m-bit width;

text data processing means, connected to the text data supply means, for receiving the text data supplied from the text data supply means and generating an n-bit text data by combining the received text data with a predetermined constant data, thereby outputting the combined n-bit text data to the display device in a superimposition mode; and graphics data processing means, connected to the division means, for selecting, in response to output timing of the n-bit text data from the text data processing means, the data obtained as a result of the division by the division means, and rearranging the divided data to an n-bit-width data, thereby outputting the rearranged graphic data to the display device in a superimposition mode.

2. The display control apparatus according to claim 1, wherein the text data supply means includes:

text memory means for storing character codes representing characters and attribute data designating display colors of the characters and colors of the background of the characters;

means for developing the character codes to dot patterns containing a plurality of dots, each of the plurality of dots being designated as a "1" or "0"; and output means connected to the developing means, for outputting one of the attribute data in accordance with the designation of each of the plurality of dots contained in the dot patterns as a "1" or "0".

3. The display control apparatus according to claim 2, wherein the text data supply means has palette means having at least one color palette register, each storing a color text data and to be selected on the basis of the attribute data from the output means.

4. The display control apparatus according to claim 1, wherein the graphics data supply means includes graphic memory means for storing data designating the color of each pixel when outputted to the display device, and means for reading, from the graphic memory means, data designating that color of a pixel which is to be displayed.

5. A display control apparatus comprising:

text data supply means for supplying text data having an m-bit width;

graphics data supply means for supplying graphics data having an n-bit width, n being larger than m;

means, connected to the text data supply means and to the graphics data supply means, for combining the m-bit-width text data, supplied from the text data supply means, with an (n–m)-bit data, thereby outputting an n-bit-width text data, in order to only display text on a display device, for outputting the n-bit-width graphics data supplied from the graphics data supply means, in order to only display graphics images on the display device; and means for outputting, for one of a plurality of dots constituting one pixel of the display device, the n-bit-width text data obtained by combining the m-bit-width text data, supplied from the text data supply means, with an (n–m)-bit data, and outputting, for another of the dots, the n-bit-width graphics data supplied from the graphics data supply means, in order to display both text and graphics images on the display device.

6. The display control apparatus according to claim 5, further comprising:

a video DAC means having a plurality of color look-up tables, to be selected based on the n-bit width text and graphics data output from the outputting means, and each of the tables storing Red-, Green-, or Blue-color data; and digital-analog conversion means for converting the Red-, Green-, Blue-color data, output from one of the selected color look-up tables, to analog signals, and outputting the analog signals to the display device.

7. The display control apparatus according to claim 5, further including:

multiplexer means for outputting upper bits and lower bits of the n-bit-width graphics data sequentially, for a time period to display at least one dot;

delaying means connected to the multiplexer means, for generating first and second delayed data obtained by delaying each of m-bit width graphic data output from the multiplexer means by a time period for displaying one dot and by a time period for displaying two dots, respectively;

first output means connected to the text data supply means, the delaying means, and the multiplexer means, for outputting, for the one of the plurality of dots constituting one pixel, the n-bit-width text data, and outputting, for another of the dots, n-bit-width graphics data obtained by combining the first and second delayed data, thereby superimposing the text and graphics images; and second output means connected to the text data supply means, the delaying means, and the multiplexer means, for outputting, for the one dot, video data obtained by combining the first delayed data and the lower bits of the n-bit-width graphics data, and outputting, for the other dot, video data delayed by a time period for displaying one dot.

8. The display control apparatus according to claim 7, further comprising designation means, for designating superimposition of text data and graphics data in units of one pixel.

9. The display control apparatus according to claim 6, wherein each pixel has first and second dots arranged adjacent to each other on a scanning line, first multiplexer means connected to the graphics data supply means, for alternately outputting upper bits and lower bits of the graphics data for a time period to display one dot;

delaying means connected to the first multiplexer means, for generating delayed first and second data by delaying the output of the first multiplexer means by half a cycle of a first control signal and by a full cycle of the first control signal, respectively;

second and third multiplexer means;

first and second flip-flop means connected to the second and third multiplexer means, respectively, for delaying the outputs of the first multiplexer means by one clock pulse;

means for combining the outputs of the first and second flip-flop means with each other and supplying the combined outputs to the video DAC means; and a selection control circuit;

wherein the second multiplexer means receives the delayed first and second data, the text data, and the output of the first flip-flop means, and the third multiplexer means receives the delayed first data, the lower bits of the n-bit-width graphic data, the output of the second flip-flop means, and fixed data;

so as to display the graphics image by the first and second dots, the selection control circuit controls, for the first dot, the second multiplexer means to select the delayed first data, and the third multiplexer means to select the lower bit data output from the first multiplexer means, and the selection control circuit controls, for the second dot, the second multiplexer means to select the output of the first flip-flop means, and the third multiplexer means to select the output of the second flip-flop means.

10. A display control apparatus for displaying a graphics image and text on a display device, the display control apparatus comprising:

text data supply means for supplying 4-bit text data;

graphics data supply means for supplying 8-bit graphics data;

first means connected to the text data supply means and to the graphics data supply means, the first means combining the 4-bit text data with 4-bit fixed data, outputting 8-bit text data, and displaying the 8-bit text data on the display device;

second means for outputting the 8-bit graphics data, and displaying the 8-bit graphics dot to the display device; and generating means for generating, for one of a plurality of dots constituting one pixel, 8-bit text data by combining the 4-bit text data with the 4-bit fixed data, and generating, for another of the dots, the 8-bit graphics data, the generating means thus superimposing the text data and graphics data upon each other on the display device; and display means connected to the generating means, for displaying an image on the basis of the 8-bit data output form the generating means;

said generating means including:

first multiplexer means for alternately outputting an upper 4 bits and a lower 4 bits of the 8-bit graphics data, for a time period to display one dot;

delaying means connected to the first multiplexer means, for generating first data by delaying the upper bit data output from the first multiplexer means by the time period for displaying one dot and second data by delaying the lower bit output data by a time period for displaying two dots, respectively;

means connected to the text data supply means, delaying means, and first multiplexer means, for outputting, for a first one of two dots constituting one pixel, 8-bit text data, and outputting, for a second one of the two dots, data obtained by combining the first data for the first dot, data obtained by combining the second data, and outputting, for the second dot, the 8-bit text data; the output means thus superimposing the text data and graphics data upon each other.

11. The display control apparatus according to claim 6, wherein each pixel has first and second dots, having first and second n-bit graphics data respectively, arranged adjacent to each other on a scanning line, first multiplexer means connected to the graphics data supply means, for alternately outputting upper bits and lower bits of the n-bit graphics data for a time period to display one dot;

delaying means connected to the first multiplexer means, for generating delayed first and second data by delaying the output of the first multiplexer means by half a cycle of a first control signal and by a full cycle of the first control signal, respectively;

second and third multiplexer means;

first and second flip-flop means connected to the second and third multiplexer means, respectively, for delaying the graphics data outputs of the first multiplexer means by one clock pulse;

means for combining the outputs of the first and second flip-flop means with each other and supplying the combined outputs to the video DAC means; and a selection control circuit;

wherein the second multiplexer means receives lower bits of the first n-bit graphics data, the lower bits of the second n-bit graphics data, the output of the second flip-flop means, and m-bit width fixed data;

so as to display the text by the first and second dots, the selection control circuit controls, for the first dot, the second multiplexer means to select the m-bit width text data, and the third multiplexer means to select the m-bit width fixed data, and the selection control circuit controls, for the second dot, the second multiplexer means to select the output of the first flip-flop means, and the third multiplexer means to select the output of the second flip-flop means.

12. The display control apparatus according to claim 6, wherein each pixel has first and second dots arranged adjacent to each other on scanning line, having first and second n-bit graphics data respectively, first multiplexer means connected to the graphics data supply means, for alternately outputting upper bits and lower bits of the n-bit graphics data for a time period to display one dot;

delaying means connected to the first multiplexer means, for generating delayed first and second data by delaying the output of the first multiplexer means by half a cycle of a first control signal and by a cycle of the first control signal, respectively;

second and third multiplexer means;

first and second flip-flop means connected to the second and third multiplexer means, respectively, for delaying the outputs of the first multiplexer means by one clock pulse;

means for combining the outputs of the first and second flip-flop means with each other and supplying the combined outputs to the video DAC means; and selection control circuit;

wherein the second multiplexer means receives the lower bits of the first n-bit graphics data, the lower bits of the second n-bit graphics data, the output of the second flip-flop means, and m-bit width fixed data;

so as to display the graphics image and text superimposed upon each other, the selection control circuit controls, for the first dot, the second multiplexer means to select the m-bit width text data, and the third multiplexer means to select the m-bit width fixed data, and controls, for the second dot, the second multiplexer means to select the second data, and the third multiplexer means to select the first dot;

the selection control circuit controls, for the first dot, the second multiplexer means to select the second dot, and the third multiplexer means to select the first data, and controls, for the second dot, the second multiplexer means to select the text data, and the third multiplexer means to select the m-bit width fixed data.

* * * * *